United States Patent [19]

Kiener

[11] 4,040,400

[45] Aug. 9, 1977

[54] INTERNAL COMBUSTION PROCESS AND ENGINE

[76] Inventor: Karl Kiener, 7081 Goldshofe, Ostalbkreis, Germany

[21] Appl. No.: 609,726

[22] Filed: Sept. 2, 1975

[51] Int. Cl.[2] ..... F22B 11/00

[52] U.S. Cl. ..... 123/68; 123/34 A; 123/143 A

[58] Field of Search ..... 123/119 CD, 119 CB, 123/120, 122 B, 122 C, 39, 34 A, 68, 143 A, 143 B; 60/39.51 R, 39.6, 39.64

[56] References Cited

U.S. PATENT DOCUMENTS

| | | | |
|---|---|---|---|
| 1,296,686 | 3/1919 | Neff | 123/119 CD |
| 1,360,041 | 11/1920 | Spohrer | 123/119 CD |
| 1,486,299 | 3/1924 | Powell | 123/34 A |
| 1,805,093 | 5/1931 | Holzwarth | 60/39.64 X |
| 1,806,581 | 5/1931 | Bethenod | 123/119 CD |
| 2,078,807 | 4/1937 | Puffer | 123/119 CD |
| 2,087,616 | 7/1937 | Mueller-Conradi et al. | 123/119 CD |
| 2,625,012 | 1/1953 | Larreco | 60/39.51 R X |
| 2,744,511 | 5/1956 | Kauffmann et al. | 123/120 |
| 3,026,859 | 3/1962 | Barnett et al. | 123/39 |
| 3,408,811 | 11/1968 | Wishart | 123/68 |
| 3,765,382 | 10/1973 | Vandenberg | 123/34 A |

*Primary Examiner*—Carroll B. Dority, Jr.
*Assistant Examiner*—Craig R. Feinberg
*Attorney, Agent, or Firm*—Kemon & Estabrook

[57] ABSTRACT

An internal combustion process and engine in which the chemical energy of a fuel is converted into heat by timed combustion using self-ignition and into kinetic energy by expansion of the hot combustion gases and is transmitted by way of a piston to a shaft. The combustion-supporting air is compressed substantially isothermally, then heated by the hot exhaust gases. Some of the compressed hot air is diverted to preheat and carburet and/or compress a fuel and the remainder of the combustion-supporting air and the combustible gas evolved are supplied separately and in substantially stoichiometric quantities to a burner nozzle, mixed therein and burned by self-ignition with a reduced excess of air and without pressure increase. The energy of the combustion gases which expand without cooling is transmitted to a piston and the exhaust gases are removed from the cylinder chamber.

25 Claims, 6 Drawing Figures

60
61
62
63
64
65
66
67
68
69
70
25
27
28
29

1
2
3
4
5
6
7
8
9
10
11
12
13
14
15
16
17
18
20
21
22
23
24
25
26
27
28
29
30
31
34
40
41
42
43
45
46
47
50
52
53
R

Fig. 4B
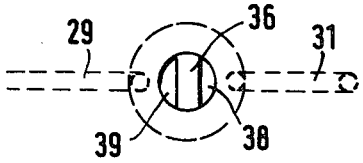
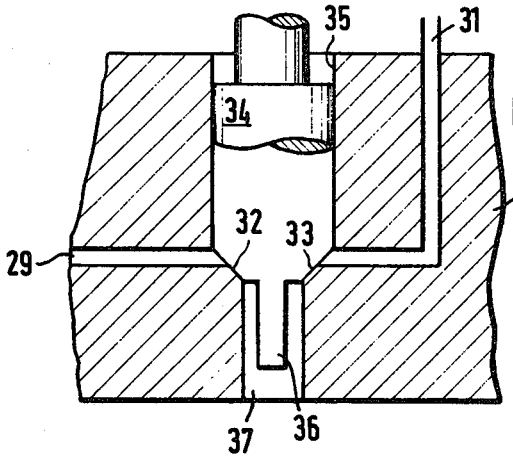
Fig. 4A
Fig.5
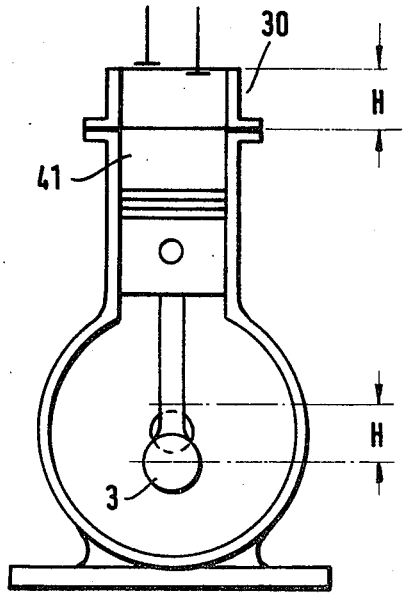

INTERNAL COMBUSTION PROCESS AND ENGINE

The invention relates to an internal combustion process in which the chemical energy of a fuel is converted into heat by timed combustion using self-ignition and into kinetic energy by expansion of the hot combustion gases; the invention also relates to a reciprocating internal combustion engine operating in accordance with the process.

In conventional thermo dynamic circuit processes such as occur e.g. in steam engines and reciprocating engines, maximum efficiency can be any where between 10 and a maximum of 40%. The main reasons for such low efficiencies are the considerable heat losses associated with expansion of the highly compressed gaseous media and with compression of the combustion-supporting air in the cylinder (more particularly in the case of internal combustion engines). Because of the properties of the materials used for pistons and cylinders and because of the properties of normal lubricating oils, the wall temperture of the cylinders or those rubbing surfaces of the liners which have to be lubricated must not exceed temperatures of from 220°-250° C. Because of the high temperatures of combustion, the average temperatures in the cylinder chamber are considerably more than 2,000° C, and so much of the heat which the hot exhaust gases transfer to the cylinder walls is removed by water or air cooling.

This unavoidable cooling of the cylinder walls is the reason for a large proportion of the in all considerable heat losses. Because of the considerable temperature difference between the interior of the cylinder and the cooled cylinder walls, considerable amounts of heat and energy are yielded to the cylinder walls and removed by coolants, more particularly during combustion of the mixture, expansion of the hot exhaust gases and during the exhaust stroke. In Otto and diesel engines the amount of heat thus lost may be as much as 30% of the heat energy of the fuel supplied.

Another disadvantage of cooling the walls of the cylinder chamber or combustion chamber is that combustion near the cooled walls proceeds at a lower temperature than at the center, with the result of incomplete combustion, a further power loss and the presence of a high proportion of unburned ingredients in the exhaust gases.

Yet another factor adversely affecting the energy balance sheet in such engines is that combustion and expansion occur in the same chamber. The hot walls and possibly parts of the residual hot exhaust gases yield heat to the media which it is required to compress and thus further increase the temperature of the gases during compression beyond the increase arising from such compression; consequently, more mechanical work is needed to achieve a required final pressure than would be needed e.g. if compression were to be substantially isothermal. Unfortunately, the only way of removing most of the heat produced by compression would be very intense cooling of the cylinder walls, with the result that the heat losses in expansion would increase and combustion would be impaired.

Another factor responsible for losses in Otto and diesel systems is the dead space between the cylinder head and the piston crown in the top dead center position, such space serving to receive the compressed and possibly partly burned combustible gases and appearing on the energy balance sheet as a distance/power loss.

Since the duration of combustion per piston stroke also depends upon the speed of engine rotation the time available for combustion is very short and, more particularly in the case of high-speed engines, often inadequate; to compensate for this disadvantage, recourse is had to increasing the excess of air in diesel engines and to adjusting or increasing preignition, because of inadequate external ignition, in Otto engines; unfortunately, such action decreases efficiency in both cases.

It is an object of the invention to provide a thermo dynamic circuit process having greatly reduced heat losses and to provide a correspondingly operating reciprocating internal combustion engine of correspondingly higher thermal efficiency and therefore having greater effective efficiency.

According to the invention, therefore, the combustion-supporting air is compressed substantially isothermally, then heated by the hot exhaust gases; some of the compressed hot air is diverted to gasify, preheat and/or compress a fuel; the combustion-supporting air and the combustible gas evolved are supplied separately and in substantially stioichiometric quantities to a burner nozzle, mixed therein and burned by self-ignition with a reduced excess of air and without pressure increase; and the energy of the combustion gases which expand without cooling is in known manner transmitted to a piston.

According to an advantageous development of the process, to prevent over heating in the combustion chamber super heated steam can be added to the combustion-supporting air or to the air-gas mixture. As a further advantageous improvement in the energy balance sheet, the super heated steam can be produced in a heat exchanger by the hot exhaust gases. The combustion-supporting air can be isothermally compressed to any required pressure, then heated by the hot exhaust gases to any technically feasible extent.

The reciprocating internal combustion engine operating in accordance with the process according to the invention is characterised by; a separate cooled compressor providing substantially isothermal compression of the combustion-supporting air; an exhaust-gas-heated heat exchanger for heating the compressed combustion-supporting air and possibly for steam-raising; a valve diverting some of the compressed heated air; provision for carburetting and/or comrpessing a fuel by the diverted air; separate combustible-gas and air passages; valves which act on both the latter passages and which serve to time the supply of gas and air to a combustion chamber disposed in the hot cylinder head, the same being thermally insulated from the cylinder, in which combustion chamber the gas-air mixture compressed in the top-dead-center zone is burned by self-ignition and without increase of pressure, and expanded; and a known exhaust valve for exhausting the expanded combustion gases from the combustion chamber into the heat exchanger during the return stroke of the piston.

Advantageously, the compressor for compressing the combustion-supporting air can be a cooled multistage reciprocating compressor whose intake valve is controlled by a critical high-pressure controller in the high pressure line and which has recoolers between its discrete compression stages. The reciprocating compressor, which is a separate unit, can be externally driven, e.g. by an electric motor; advantageously, however, the reciprocating compressor is directly coupled with the engine crank shaft. A single compressor can supply, possibly with the assistance of a pressure accumulator, a number of cylinders of an engine with combustion-supporting air.

The ratio of air to fuel, and therefore maintenance of optimum combustion conditions, are controlled by an exhaust gas sensor which detects the percentages of unburnt hydrocarbons and carbon monoxide and/or carbon dioxide and nitric oxide contents in the exhaust gases continuously, and by thermostats in the exhaust pipe and in the cylinder head. The exhaust gas sensor and the thermostats act jointly on a final control element which operates the valve appropriately and thus adapts the air-fuel ratio to instantaneous operating conditions.

To improve the combustion process, more particularly to lower the flame temperatures near the burner, the heat exchanger comprises an evaporator which is flowed round by the hot exhaust gases and whose high-pressure outlet is connected either directly to the burner by way of a separate line or to the high-pressure air line.

When liquid fuels, such as gasoline or diesel fuel, are used, the fuel-preparing provision or facility can take the form of a carburetter supplied with the liquid fuel by way of an injection line and a pump. So that the engine may be operated on fuels of different consistencies and which cannot be gasified without residue, it may be advantageous to provide two carburetters in parallel with one another which can be brought into operation alternately, it being possible for one of the carburetters to be cut out of operation and cleaned or possibly even replaced without the engine having to be stopped.

Of great assistance in the endeavours of the invention to improve engine efficiency is a cylinder head formed, in extension of the or each of its cylinders, with recesses into which the top part of the piston extends unguided and so as to bound a narrow annular gap in the top regions of its stroke and in which combustion occurs at a substantially constant pressure. Thermally, the technical advantage of such a cylinder head lies in the possiblility of insulating the head from the cooled cylinders of the cylinder block and thus of retaining the heat in the uncooled walls of the cylinder-head recesses surrounding the combustion chambers without shortening the working life of the engine.

The recesses are so devised that when the or each piston is in its top-dead center position the gap which must be present between the recess end wall and the piston end wall in conventional reciprocating internal combustion engines to receive the highly compressed fuel mixture is absent. To reduce heat stressing of the cylinder-head material and in particular of the piston end wall, the recess inner walls can have a thin coating of a highly refractory material; however, the inner diameter of the cooled recesses must remain slightly larger than the piston diameter so as leave the annular gap.

To further reduce the unwanted removal of heat from the combustion chamber to the cylinder block, the pistons can in conventional manner be hollow pistons and can have heat insulation on their inner walls.

Since no work of compression has to be carried out in the cylinder and the combustible or burned gases are introduced into the cylinder only during each working stroke, every other piston stroke — i.e., every outward stroke — is a working stroke. This feature leads to the further advantage that an exhaust valve provided e.g. in the cylinder head can remain open througout the return stroke, thus ensuring uniform removal of the expanded combustion gases during the return stroke of the piston.

Since combustible gas from the gasification facility and combustion-supporting air are supplied to the nozzle through flow passages in a cylinder head heated to the self-igniting temperature of the mixture and since combustion may be initiated only during or shortly before the top-dead center position of the piston, a specially devised timed valve must be provided. Such a valve ensures that the two gases merge for the first time in the burner nozzle, where they experience very intensive eddying. Since combustion occurs in the nozzle without any increase of pressure, there is no risk of backfiring in the event of incomplete gasification of the fuels and of the presence of air in the combustible-gas line.

The valve providing timed mixing of the two gases can be e.g. a valve of the kind used in a similar form in high-pressure steam engines. Considerable advantages, however, are provided by a valve of a kind wherein a tappet guided vertically in a corresponding recess in the cylinder head bears by way of bottom inclined surfaces on inclined surfaces of the cylinder-head recess, the latter surfaces being devised as valve seats. Extending to each of the cylinder-head inclined surfaces is a flow passage for the combustible gas and a flow passage for the combustion-supporting air. At its bottom end the tappet has a portion which divides the top part of the nozzle in two chambers, the side walls of such portion being shaped to produce eddying. The portion is guided by way of its curved narrow sides by the burner walls and thus prevents premature mixing of the two gases when the valve is open. Of course, one valve each can be provided for controlling the supply of combustible gas and the supply of combustion-supporting air, with the consequent advantage of separate control of the quantity of each substance.

Embodiments of the invention will be described in greater detail hereinafter with reference to the drawings wherein:

FIG. 4A is a vertical section through the valve and burner used in the engines shown in FIGS. 1 and 3;

FIG. 4B is a bottom view of the valve shown in FIG. 4A, and

FIG. 5 is a diagrammatic front view of the engine according to the invention.

Figure 1:
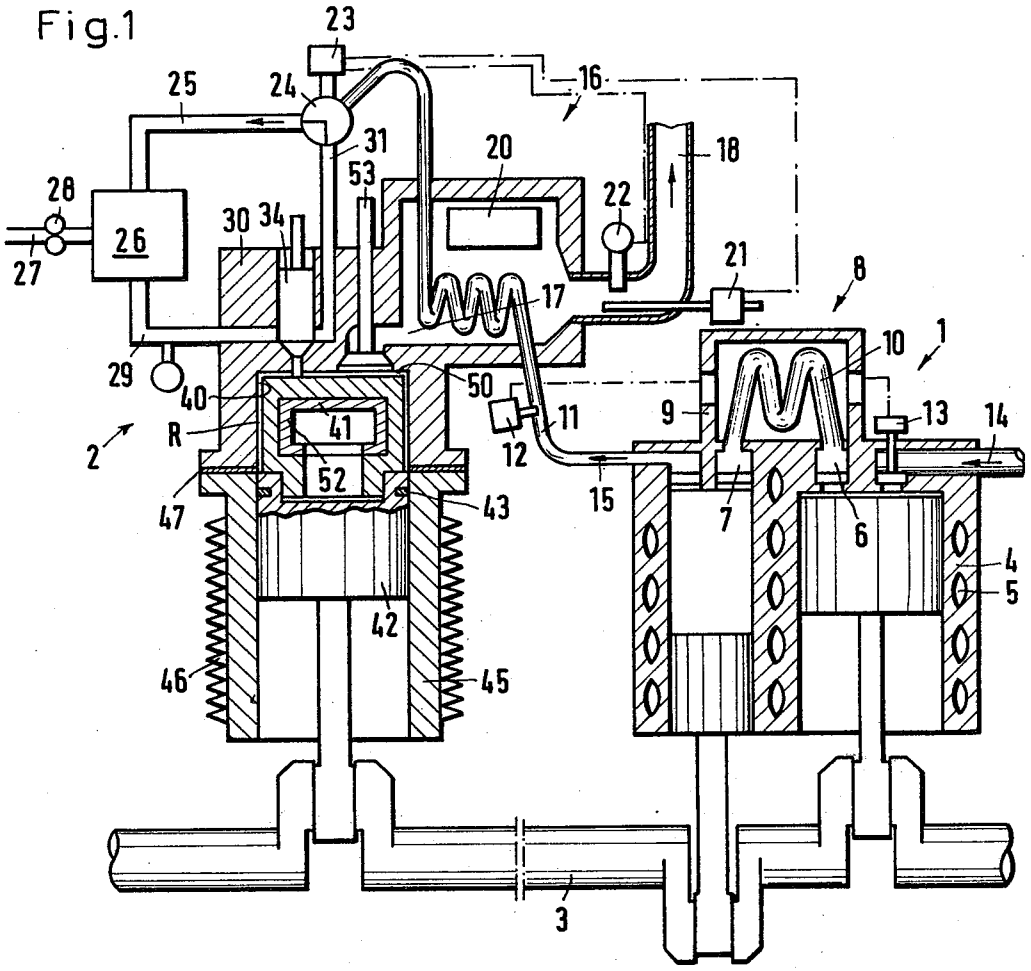
FIG. 1 is a vertical section through an embodiment of the reciprocating internal combustion engine according to the invention, for use with fuels gasifying without leaving residue.

The engine shown in FIG. 1 comprises two separate units or groups, viz., a multistage reciprocating compressor 1 and an internal combustion engine 2 with its appropriate ancillaries. The pistons of both units are in conventional manner connected by connecting rods to a single crank shaft 3.

Walls 4 of compressor 1 are formed with flow passages 5 for a coolant. Interposed between outlet 6 of the low-pressure stage and inlet 7 of the high-pressure stage is a recooler 8, in the form of a casing 9 and pipe coils 10. Disposed in high-pressure line 11 is a pressure-limiting valve 12 which acts in conventional manner on a valve 13 in intake 14 of the low-pressure stage.

Combustion-supporting air which has been compressed substantially isothermally flows through high-pressure line 11, as indicated by an arrow 15, to a heat exchanger 16; the hot exhaust gases flow through an exhaust pipe 17 in exchanger 16 and are then discharged to atmosphere via a line 18. To ensure very thorough heat exchange, the high-pressure line 11 in the heat exchanger 16 is embodied as a pipe coil. Also provided in the heat exchanger 16 to heat the combustion-supporting air is an evaporator 20 in which water or wet steam is heated and possibly compressed so as to reduce the flame temperatures in the burner.

Disposed in the exhaust line 18 are an exhaust gas sensor 21 and a thermostat 22 whose observed values are transmitted to a final control element 23 acting on a three-way valve 24; some of the heated and highly compressed combustion-supporting air reaching valve 24 is diverted through a line 25 to a facility 26 for gasification of liquid fuel supplied by way of a line 27 and pump 28. The resulting combustible gas leaves through a line 29.

Most of the combustion-supporting air flows from valve 24 through a line 31, at least some of which is contrived in cylinder head 30. The gas line 29 and the air line 31 extend to inclined surfaces 32,33 respectively of a valve seat (see FIG. 4). Bearing on surfaces 32,33 is a cylindrical tappet 34 which is guided in a recess 35 in the cylinder head. The bottom inclined surfaces of tappet 34 close or open the two lines 29,31 simultaneously. Tappet 34 terminates in a bottom web or portion or the like 36 which subdivides the top part of a combustion chamber length-wise into a chamber 38 for the combustion-supporting air and a chamber 39 for the combustible gas, with the result that there is intensive mixing of the two gases, and therefore ignition, below its free end in the burner nozzle 37.

Figure 3:
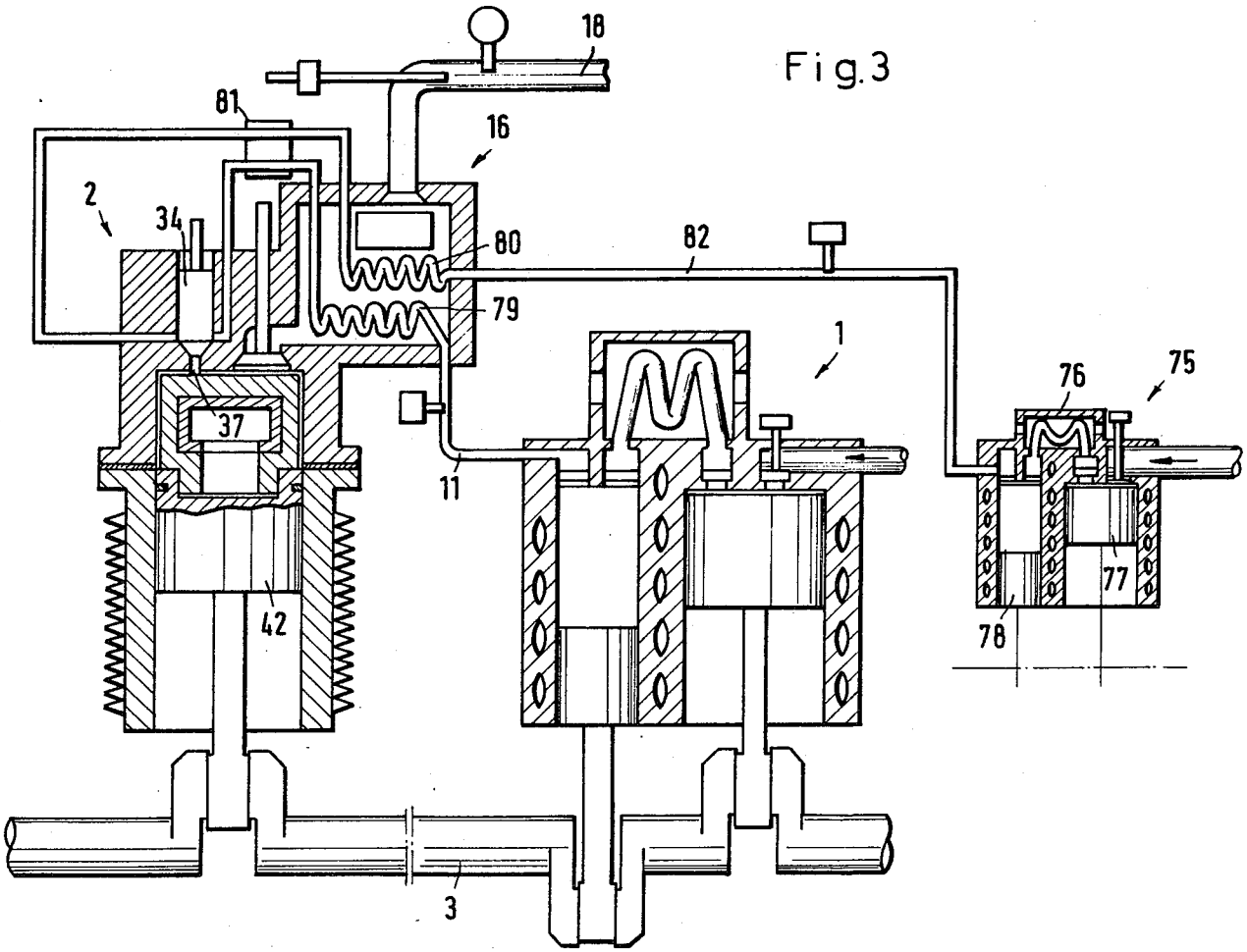
FIG. 3 is a vertical section through another embodiment of the engine according to the invention, for gaseous fuels compressed in a separate compressor.

As indicated in FIGS. 1 and 3, cylinder head 30 is formed with a cylindrical recess 40 into which top part 41 of piston 42 extends. Recess 40 is the combustion and expansion chamber. Its diameter is slightly greater than the diameter of the piston top part 41 so that the piston moves unguided in recess 40, leaving an annular gap R. The piston is guided by ordinary piston rings 43 which are disposed in the bottom part of piston 42 and which engage with the inner walls of conventional cylinder liners. To keep down cylinder wall temperatures to the values necessary for the lubricants, the cylinder 45 and has air-cooling ribs or fins 46. Of course, the cylinder walls 45 can be cooled by liquid coolants, e.g. water.

To maintain the required high temperatures in the cylinder-head recess 40 and to inhibit any appreciable heat transfer from cylinder head 30 to the cooled cylinder block, an insert 47 providing considerable heat insulation is provided at the junction. The inner walls of recess 40 and at least the top end wall of piston 42 are coated with a thin covering 50 of a highly refractory material so as to maintain the thermal stressing of the cylinder-head material within limits. The side walls of the piston top part 41 can be coated with the refractory material. To inhibit intensive heat radiation by the cylinder walls into the interior of the hollow piston 42, such interior has heat insulation 52 at least near the top part of the piston.

The exhaust line 17 to the heat exchanger merges into the end wall of the cylinder-head recess 30 and is closed and opened by a conventional timed exhaust valve 53.

The engine according to the invention operates as follows:

Air supplied through intake line 14 is compressed in the cooled multistage compressor 1, the heat of compression which is evolved being removed substantially by cooling of the piston walls and by the recooler 10, so that compression proceeds substantially isothermally. The air, which can be compressed to any technically feasible pressure, is heated as far as possible in the heat exchanger by the hot gases, then goes to the three-way valve 24. The quantity of air diverted thereby gasifies the liquid fuel supplied through line 27 in the facility 26 and forces the highly-compressed hot combustible gas through line 29, when the tappet 34 is at its raised position, into chamber 39 above burner 37 (see FIGS. 4A and 4B), Most of the combustion-supporting air flows from the valve 24 through the line 31, when the tappet 34 is in its raised position, to the chamber above the nozzle 37, such chamber being bounded by the tappet portion 36. Because of the sinuous construction of the side walls of portion 36, when the tappet 34 is open both gases have imparted to them a whirl which leads to intensive eddying in the nozzle 37. Combustion then occurs as a result of collisions between the hot molecules of combustible gas and oxygen, such molecules being at a temperature beyond the self-ignition temperature and above the temperature of the hot walls of the nozzle or of the cylinder head and cylinder crown, without any increase in pressure, the duration of combustion corresponding, assuming a constant input of combustible gas and air to the nozzle 37, to a predetermined angle of crank shaft rotation — i.e., to a predetermined amount of piston travel. If the cylinder-head recess walls which are in contact with the combustion gases have been given an economically feasible protecting against heat loss, the surfaces of such walls have a temperature at full engine load of approximately 1000° C. Expansion of the combustion gases and the associated temperature decrease gives the gas the possibility and sufficient time to burn the final unburnt mixture gas residues at a very low excess of air coefficient since the entire combustion chamber is bounded by hot wall surfaces, the known difficulties of complete combustion of the combustible gases which are on or near the coolled walls being prevented by excessive cooling do not occur.

A highly refractory insulating layer of a thickness of from 3–4/10mm can be applied to the walls of the cylinder-head recess and of the piston top part by plasma spraying; such a layer can store the heat energy in the highest temperature range until most of such energy has been restored to the gases as they cool during expansion. The quantity of heat which does not have to be removed by the engine coolant remains available to the thermo dynamic process and so does not have to be "topped up" by fuels.

If flame temperatures in the burner become excessive when high-energy fuels are used, it may be expedient either to mix the combustion-supporting air with high-pressure steam produced in the evaporator 20 or to supply such steam through separate lines to the burner or to the fuel-gasifying facility.

Figure 2:
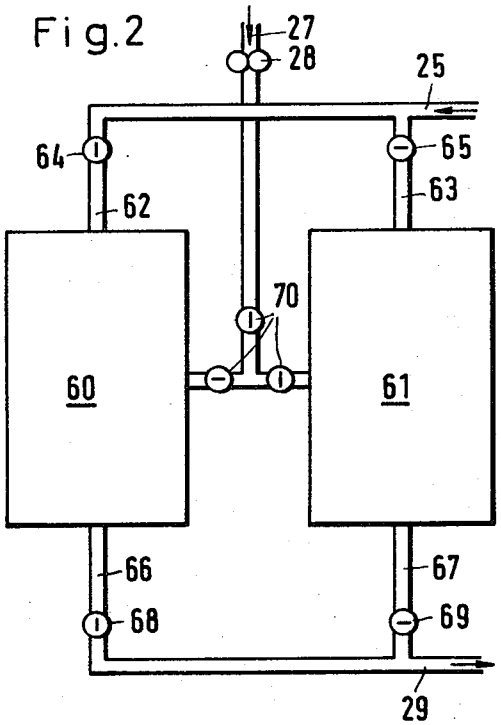
FIG. 2 is a diagrammatic view of the parallel-connected facilities for use with fuels which can not be gasified without leaving a residue.

FIG. 2 is a diagrammatic view of a facility for gasifying fuel, the facility comprising two identical units 60,61. One line each 62,63 extends from the line 25 to each unit 60,61, the lines comprising selectively operable shut-off elements 64,65. Discharge lines 66,67 having corresponding shut-off elements 68,69 extend to line 29. Fuel is supplied by way of line 27 and pump 28 and a three-way valve 70 to each of the units 60 or 61 at choice. With a gasification unit thus devised, fuels which do not gasify without leaving residue can be used, since each of the gasification or carburation units can be cut out of operation by appropriate operation of the various valves or shut-off elements and cleaned or replaced without operation of the engine having to stop. Solids fuels, such as coal or the like and thickly viscous unpurified fuels, such as tar, fuel oil, old oil, etc., can be used with facilities of this kind to drive internal combustion engines. If required, instead of the two units 60,61 even more units can be provided and connected in parallel. In special cases a connection can be provided between the two units 60 and 61 by the valve 70 to ignite the fresh material introduced into the adjacent chamber.

The engine shown in FIG. 3 corresponds in its main items to the engine shown in FIG. 1 and so there is no need to repeat the general comments here. The embodiment shown in FIG. 3 is of use for burning gaseous fuels. The same are compressed in a small multistage reciprocating compressor 75 substantially isothermally; the compressor 75 can also be driven by the crank shaft 3. Accordingly, a recooler 76 is provided between the low-pressure stage 77 and high-pressure stage 78. Both the compressor 1 and the compressor 75 compress their respective medium to the same pressure, e.g. from 40 to 50 atmospheres gauge. The combustion-supporting air and the combustible gas are heated in two pipe coils around which the hot exhaust gases flow; quantities are so controlled by a controller 81 that the required mixture of gas and air which burns at a constant pressure with self-ignition arises in the burner 37. Combustion proceeds without pressure increase until inlet valve 34 closes; piston 42 moves in the cylinder through a distance corresponding at full load substantially to that volume of a diesel engine occupied by the burnt gases after ignition and combustion of the injected diesel oil. To increase engine power, the or each inlet valve permits "filling" only to the extent necessary to obtain such power, as is the case e.g. with reciprocating steam engines. The or each compressor provides only the quantities of gas required for immediate operating circumstances. Closure of tappet 34 is followed by pure expansion of the combustion gases without appreciable afterburning. The use of a separate cooled compressor 75 for the combustible gases and the fact that the same are heated by the exhaust gases in the heat exchanger 16 mean that any gas can be burnt safely at high pressure with optimum efficiency.

As in the case of the embodiment shown in FIG. 1, the valve facility shown in FIG. 4A is responsible for the timed supply and formation of the mixture in the nozzle 37.

FIG. 5 shows that the depth of the recess 40 in the cylinder head 30 should correspond as far as possible to the piston stroke, thus ensuring that the combustion chamber exists only in the thermally insulated cylinder head, so that only a very small amount of heat reaches the engine coolant.

When the engine is cold and the air and gas are unheated, the ignition can be provided by a continuous arc of a spark plug or hot plug near the gas and air entries into the cylinder. External igition is maintained until operating temperature is high enough for self-ignition.

The engine according to the invention can run to either hand of rotation.

I claim:

1. An internal combustion process wherein combustion-supporting air is compressed outisde of a working cylinder-piston and compressed air and a gaseous fuel are supplied separately in predetermined quantities to a burner nozzle and mixed therein and ignited and burnt without increasing the pressure in the cylinder-piston and wherein the energy of the combustion gases which expand without cooling is transmitted to the working piston and the exhaust gases are removed from the working cylinder, characterized in that the combustion-supporting air is compressed substantially isothermally then heated by the hot exhaust gases with some of the compressed hot air being diverted to preheat and carburet and compress the fuel with the remainder of the combustion-supporting air and the combustible gas evolved being burnt substantially stoichiometrically by self-ignition.

2. A process according to claim 1, characterized in that the heat evolved in the isothermal compression is removed by a coolant.

3. A process according to claim 1, characterized in that the cylinder walls are cooled only during the bottom part of the piston stroke.

4. A process according to claim 1, characterized in that the combustible gas formed from the liquid fuel and the proportion of combustion-supporting air, and the combustion-supporting air, ignite immediately upon contact with one another.

5. An internal combustion engine in which a combustible gas and a combustion-supporting air are supplied precompressed to a cylinder-piston by separate channels and at least one controlled burner nozzle, the mixture formed in the burner nozzle being burnt in the cylinder-piston without substantial pressure increase, characterized by a separate air compressor for providing substantially isothermal compression of the combustion-supporting air; an exhaust-gas-heated heat exchanger for heating the compressed combustion-supporting air; a valve for diverting some of the compressed heated combustion-supporting air to the burner nozzle; means for carburetting and compressing a fuel and receiving the remainder of the diverted air; means connecting, said fuel carbureting and compressing means with said burner nozzle; a combustion chamber in the head of said cylinder which is thermally insulated from said cylinder and being in communication with said burner nozzle and in which the combustible gas and air which have been compressed separately are in the top-dead-center region of said cylinder head burnt by self-ignition; an exhaust valve for exhausting the expanded combustion gases from the combustion chamber into the heat exchanger during the piston return stroke, the power being controlled steplessly from idling to full power by variations in filling produced by operation of the valves.

6. An engine according to claim 5, characterized in that the valve controlling the gas/air supply to the combustion chamber has a tappet which is guided in a recess in the cylinder head and which when in its closed position bears by way of bottom inclined surfaces on matching inclined seating surfaces and which terminates in a portion, which when in the raised position, subdivides the top part of the nozzle-like combustion chamber into a gap for combustion-supporting air and a gap for combustible gas, the line for the combustion-supporting air terminating near the inclined surface and the line for the combustible gas terminating near the inclined surface of the valve seat.

7. An engine according to claim 6, characterized in that those walls of the tappet portion which bound the gap chambers are shaped to produce a whirling flow and to cause intimate eddying of the gases in the nozzle.

8. An engine according to claim 5, characterized in that the air compressor is cooled.

9. An engine according to claim 5, characterized in that the air compressor is a multi-stage compressor.

10. An engine according to claim 9, characterized in that recoolers in the form of cooling chambers are provided between the individual compression stages of the compressor.

11. An engine according to claim 5, characterized in that a limit pressure controller controlling the inlet valve is disposed immediately the downstream from the compressor.

12. An engine according to claim 5, characterized in that the compressor is coupled to the the engines output shaft.

13. An engine according to claim 9, characterized in that the multi-stage piston compressor is directly connected to the engine crankshaft.

14. An engine according to claim 15, characterized in that the heat exchanger comprises a coil which is flowed around by the hot exhaust gases and is connected to the compressor delivery by a pressure line.

15. An engine according to claim 1, characterized in that an element controlled by the waste gas and temperature and which varies the air-fuel ratio is associated with the diverting valve.

16. An engine according to claim 5, characterized in that the heat exchanger contains an evaporator which is flowed around by the hot exhaust gases and whose vapour outlet is connected to the air line.

17. An engine according to claim 5, characterized in that the means for preparing the combustible gas is a carburettor for liquid fuels which is connected via an injection line to a compressing pump.

18. An engine according to claim 5, characterized in that two carburettor units adapted to be brought into operation alternately are provided in parallel.

19. An engine according to claim 5, characterized in that the cylinder head is fashioned with separate flow passages for the combustion-supporting air and for the combustion gas, such passages merging in a controlled burner nozzle disposed in the cylinder head.

20. An engine according to claim 5, characterized in that the cylinder head is formed with at least one recess in which the top part of the piston extends unguided and in which combustion occurs at a substantially constant pressure.

21. An engine according to claim 5, characterized in that the cylinder head is thermally insulated from the cooled cylinder walls which guide the piston bottom part.

22. An engine according to claim 20, characterized in that the inner walls of the cylinder-head recess and the outer walls of the piston top part are coated with a highly refractory material.

23. An engine according to claim 5, characterized in that to form a narrow annular gap the diameter of the piston top part is less then the diameter of the recess in the cylinder head.

24. An engine according to claim 5, characterized in that the inner walls of the pistons have insulation.

25. An engine according to claim 5, characterized in that the cylinder head has at least one exhaust valve which during each piston return stroke is open for at least substantially the entire time taken for the return stroke.

* * * * *